US010335928B2

(12) United States Patent
Wang

(10) Patent No.: US 10,335,928 B2
(45) Date of Patent: Jul. 2, 2019

(54) QUIET WRENCH

(71) Applicants: HANGZHOU GREAT STAR TOOLS CO., LTD., Hangzhou, Zhejiang Province (CN); HANGZHOU GREAT STAR INDUSTRIAL CO., LTD., Hangzhou, Zhejiang Province (CN)

(72) Inventor: Min Wang, Hangzhou (CN)

(73) Assignees: HANGZHOU GREAT STAR TOOLS CO., LTD., Hangzhou, Zhejiang Province (CN); HANGZHOU GREAT STAR INDUSTRIAL CO., LTD., Hangzhou, Zhejiang Province (CN)

( * ) Notice: Subject to any disclaimer, the term of this patent is extended or adjusted under 35 U.S.C. 154(b) by 220 days.

(21) Appl. No.: 15/325,614

(22) PCT Filed: Jul. 11, 2014

(86) PCT No.: PCT/CN2014/082039
§ 371 (c)(1),
(2) Date: Jan. 11, 2017

(87) PCT Pub. No.: WO2016/004620
PCT Pub. Date: Jan. 14, 2016

(65) Prior Publication Data

US 2017/0144275 A1 May 25, 2017

(51) Int. Cl.
*B25B 13/46* (2006.01)
*B25B 13/48* (2006.01)
(Continued)

(52) U.S. Cl.
CPC ..... *B25B 13/462* (2013.01); *B25B 13/00* (2013.01); *B25B 13/48* (2013.01); *B25B 23/0007* (2013.01)

(58) Field of Classification Search
CPC ..... B25B 13/46; B25B 13/462; B25B 13/48; B25B 23/0007; F16D 41/08
See application file for complete search history.

(56) References Cited

U.S. PATENT DOCUMENTS 4,297,924 A 11/1981 Lane
4,802,387 A 2/1989 Williams, III
(Continued)

FOREIGN PATENT DOCUMENTS

AU 5891773 A 2/1975
CN 1128195 A 8/1996
(Continued)

OTHER PUBLICATIONS

International Search Report (English—2 pages) for Application No. PCT/CN2014/082039 dated Dec. 30, 2014.
(Continued)

*Primary Examiner* — David B. Thomas
(74) *Attorney, Agent, or Firm* — Fitch, Even, Tabin & Flannery LLP

(57) ABSTRACT

The present invention provides a wrench comprising a handle, having a cylindrical inner surface as a first surface; a torque output member, arranged within the first surface of the handle, the torque output member having a cylindrical outer surface as a second surface; one or more wedging member(s), arranged between the first surface and the second surface; varied distance being between the first surface and the second surface, so that the wedge members can prevent the rotation of the first surface relative to the second surface in a predetermined direction. The wrench according to the present invention adopts wedge member to prevent the rotation of the handle relative to the torque output member. When the handle idles relative to the torque output member, only the wedge member will leave the stop position and no sound will be made. Such a wrench is a quiet wrench.
(Continued)

Adopting such a configuration not only can reduce wearing of the wrench, extend the service life of the wrench, and improve the user's experience. Providing pre-tightening force can effectively reduce the interval and make the operation smoother.

35 Claims, 8 Drawing Sheets

(51) Int. Cl.
*B25B 23/00* (2006.01)
*B25B 13/00* (2006.01)

(56) References Cited

U.S. PATENT DOCUMENTS 5,619,890 A 4/1997 Hattori et al.
5,937,981 A * 8/1999 Adams ..... B25B 13/462 192/43
6,067,881 A 5/2000 Albertson
6,769,328 B1 * 8/2004 Patel ..... B25B 13/462 192/45.001
6,807,881 B2 * 10/2004 Wu ..... B25B 13/462 81/59.1
7,036,400 B2 * 5/2006 Matsumoto ..... B25B 13/462 192/43.2
7,181,998 B2 * 2/2007 Matsumoto ..... B25B 13/462 81/58.2
7,240,590 B1 * 7/2007 Lin ..... B25B 13/462 81/177.85
7,261,019 B1 * 8/2007 Lin ..... B25B 13/462 81/59.1
8,186,246 B2 * 5/2012 Niven ..... B25B 13/462 166/77.51
8,613,350 B2 * 12/2013 Nease, III ..... F16D 41/088 192/44
8,904,907 B2 * 12/2014 Douglass ..... B25B 13/462 81/59.1
2002/0144575 A1 * 10/2002 Niven ..... B25B 13/462 81/57.39
2004/0007437 A1 * 1/2004 Linzell ..... B23B 31/1612 192/38
2005/0061114 A1 * 3/2005 Lin ..... B25B 13/462 81/59.1
2005/0120832 A1 * 6/2005 Chiang ..... B25B 13/461 81/59.1
2006/0016295 A1 * 1/2006 Hsien ..... B25B 13/462 81/59.1
2006/0108194 A1 * 5/2006 Phillips ..... B25B 13/461 192/44
2007/0163398 A1 * 7/2007 Lai Lee ..... B25B 13/462 81/59.1
2008/0141832 A1 * 6/2008 Phillips ..... B25B 13/461 81/60
2008/0276762 A1 * 11/2008 Dein ..... B25B 13/461 81/59.1
2010/0101815 A1 4/2010 Kobayashi
2011/0138970 A1 6/2011 Nguyen et al.
2013/0008755 A1 * 1/2013 Lai ..... B25B 13/462 192/44
2014/0060257 A1 * 3/2014 Douglass ..... B25B 13/462 81/59.1
2014/0116205 A1 5/2014 Wang
2014/0260819 A1 * 9/2014 Gummow ..... B25B 13/462 81/63.1
2015/0174745 A1 * 6/2015 Chen ..... B25B 23/141 81/480
2015/0306745 A1 * 10/2015 Ross ..... B25B 13/462 81/59.1

FOREIGN PATENT DOCUMENTS

CN 101214641 A 7/2008
CN 101269484 A 9/2008
CN 102305250 A 1/2012
CN 202507204 U 10/2012
CN 102862137 A 1/2013
CN 203045591 A 7/2013
CN 203045591 U 7/2013
CN 204140696 U 2/2015
DE 202005014846 U1 11/2005
EP 0733438 A1 9/1996
EP 1380390 A2 1/2004
JP S5022397 A 3/1973
JP H1080870 A 3/1998
JP 2011131322 A 7/2011
WO 0066328 A1 11/2000

OTHER PUBLICATIONS

Written Opinion (English—9 pages) for Application No. PCT/CN2014/082039 dated Dec. 30, 2014.

* cited by examiner

QUIET WRENCH

FIELD OF THE INVENTION

The present invention relates to a hand tool, more specifically relates to a quiet wrench.

DESCRIPTION OF THE PRIOR ART

In general usage of a torque wrench, hand movement in the direction of rotation is limited and can not rotate in a direction continually. In such kind of wrench, the rotation shaft of the handle and the main shaft are coaxial. When being used, the handle is first rotated in a desired direction by hand (e.g., tightening or loosening a piece), then the handle is need to be rotated in a reverse direction in order to enter the next cycle. In the above reverse rotation, generally a one-way clutch like ratchet surface mechanism is provided in the wrench, so that the main shaft can be fixed while the handle is reversed, i.e., the handle idles relative to the main shaft, to avoid the re-position of the wrench after it is disengaged from the workpiece.

However, with the one-way clutch like ratchet surface mechanism, a sound will be made when the handle idles relative to the main shaft, which not only increases wearing of the wrench and has impact on the service life of wrench, but also affect the user experience of the wrench.

The skilled people in the art are committed to providing a quiet wrench, which will not only be able to avoid the re-position of the wrench to the workpiece after their disengagement, but also ensure that no sound is made when the handle is idling relative to the main shaft.

SUMMARY OF THE INVENTION

An object of the present invention is to provide a one-way clutch, and the one-way clutch comprises a first surface and a second surface, having a varied distance there between, and one or more wedge member(s) arranged between the first surface and the second surface. The rotation of the first surface relative to the second surface in a predetermined direction is prevented by the wedge member, i.e. the first surface drives the second surface to rotate; while in the opposite direction to the predetermined direction, the wedge member leaves the stop position, and the first surface rotate in the direction opposite the predetermined direction relative to the second surface, without driving the second surface to rotate.

According to the one-way clutch provided in the present invention, when the first surface idles relative to the second surface, only the wedge member will leave the stop position and no sound will be made. Adopting such a configuration can not only reduce wearing but also extend the service life of the one-way clutch.

The present invention provides a wrench, comprises a cylindrical inner surface at one end of the handle, being a first surface; the cylindrical outer surface of the torque output member, being a second surface; and one or more wedge member(s) arranged between the first surface and the second surface. A varied distance is between the first surface and the second surface, so that the wedge member can prevent the rotation of the first surface relative to the second surface in a predetermined direction, i.e. the first surface drives the second surface to rotate; while in the opposite direction to the predetermined direction, the wedge member leaves the stop position, and the first surface rotate in the direction opposite the predetermined direction relative to the second surface, without driving the second surface to rotate, i.e. the handle does not drive the torque output member to rotate, but idles relative to the torque output member.

In the wrench according to the present invention, when the handle idles relative to the torque output member, only the wedge members will leave the stop position and no sound will be made. Such a wrench is a quiet wrench. Adopting such a configuration can not only reduce wearing of the wrench but also extend the service life of the wrench. And because the wrench is quiet, the user's experience will be improved.

The present invention provides a one-way clutch, comprising:

a first surface;

a second surface;

the first surface and the second surface being cylindrically curved surfaces, the second surface being located inside the first surface;

one or more wedge member(s), arranged between the first surface and the second surface; and a distance, which varies along the radial direction of the first surface, is between the first surface and the second surface, so that the wedge member(s) can prevent the rotation of the first surface relative to the second surface in a predetermined direction.

The one-way clutch provided by the present invention prevents the rotation of the first surface relative to the second surface in a predetermined direction by the wedge member, i.e. the first surface drives the second surface to rotate; while in the opposite direction to the predetermined direction, the wedge member leaves the stop position, and the first surface rotate in the direction opposite the predetermined direction relative to the second surface, without driving the second surface to rotate.

According to the one-way clutch provided in the present invention, when the first surface idles relative to the second surface, only the wedge member will leave the stop position and no sound will be made. Adopting such a configuration will not only reduce wearing but also extend the service life of the one-way clutch.

Further, the first surface and the second surface are arranged coaxially.

Further, at least one of the first surface and the second surface has radius varying along the radial direction of the first surface.

Further, the first surface is cylindrically curved surface and the second surface has radius varying along the radial direction of the second surface.

Further, the cross-sectional profile of the second surface includes fold line or arc line.

Further, the fold line or arc line may be one or more.

Further, when there are more than one fold lines or arc lines, the lines are evenly distributed along the radial direction of the second surface.

Further, the cross-sectional profile of the second surface is hexagon.

Further, the second surface is cylindrically curved surface and the first surface has radius varying along the radial direction of the first surface.

Further, the cross-sectional profile of the first surface includes fold line or arc line.

Further, the fold line or arc line may be one or more.

Further, when there are more than one fold lines or arc lines, the lines are evenly distributed along the radial direction of the first surface.

Further, both the first surface and the second surface have radius varying along the radial direction of the first surface.

Further, the wedge member may be cylindrical structure or spherical structure.

Further, when the wedge member is cylindrical structure, the axis of the wedge member is parallel to the axis of the first surface.

Further, the position where the distance between the first surface and the second surface varies clockwise from longer than the diameter of the wedge member to shorter than the diameter of the wedge member forms a first stop position; the position where the distance between the first surface and the second surface varies clockwise from shorter than the diameter of the wedge member to longer than the diameter of the wedge member forms a second stop position.

Further, the wedge member is at the first stop position by a pre-tightening force applied to the second surface and the predetermined direction is clockwise direction; the wedge member is at the second stop position by a pre-tightening force and the predetermined direction is counter-clockwise direction.

Further, the one-way clutch further comprises a reversing apparatus for moving the wedge member between the first stop position and the second stop position.

Further, the one-way clutch further comprises a holding frame and the wedge member is mounted on the holding frame.

Further, the holding frame is cage-like.

Further, the reversing apparatus is a knob or toggle, the knob or toggle is fixedly connected to the holding frame.

The present invention further provides a wrench, comprising:

a handle for torque input, a first end of the handle having a cylindrical inner surface as a first surface;

a torque output member, arranged in the first surface of the handle, the torque output member having a cylindrical outer surface as a second surface;

one or more wedge member(s), arranged between the first surface and the second surface; and a distance, which varies along the radial direction of the first surface, is between the first surface and the second surface, so that the wedge member(s) can prevent the rotation of the first surface relative to the second surface in a predetermined direction.

The wrench according to the present embodiment adopts the wedge members to prevent the rotation of the first surface relative to the second surface in a predetermined direction, that means the handle drives the torque output member to rotate; while in the opposite direction to the predetermined direction, the wedge members leave the stop position, and the first surface rotates in the direction opposite the predetermined direction without driving the second surface to rotate, that means the handle does not drive the torque output member to rotate and the handle idles relative to the torque output member.

In the wrench according to the present invention, when the handle idles relative to the torque output member, only the wedge members will leave the stop position and no sound will be made. Such a wrench is a quiet wrench. Adopting such a configuration can not only reduce wearing of the wrench but also extend the service life of the wrench. And because the wrench is quiet, the user's experience will be improved.

Further, the first surface and the second surface are arranged coaxially.

Further, at least one of the first surface and the second surface has radius varying along the radial direction of the first surface.

Further, the first surface is cylindrically curved surface and the second surface has radius varying along the radial direction of the second surface.

Further, the cross-sectional profile of the second surface includes fold line or arc line.

Further, the fold line or arc line may be one or more.

Further, when there are more than one fold lines or arc lines, the profile of the lines are evenly distributed along the radial direction of the second surface.

Further, the cross-sectional profile of the second surface is hexagon.

Further, the second surface is cylindrically curved surface and the first surface has radius varying along the radial direction of the first surface.

Further, the cross-sectional profile of the first surface includes fold line or arc line.

Further, the fold line or arc line may be one or more.

Further, when there are more than one fold lines or arc lines, the lines are evenly distributed along the radial direction of the first surface.

Further, both the first surface and the second surface have radii varying along the radial direction of the first surface.

Further, the wedge member may be cylindrical structure or spherical structure.

Further, when the wedge member is cylindrical structure, the axis of the wedge member is parallel to the axis of the first surface.

Further, the position where the distance between the first surface and the second surface varies clockwise from longer than the diameter of the wedge member to shorter than the diameter of the wedge member forms a first stop position; the position where the distance between the first surface and the second surface varies clockwise from shorter than the diameter of the wedge member to longer than the diameter of the wedge member forms a second stop position.

Further, the wedge member is at the first stop position by a pre-tightening force applied to the second surface and the predetermined direction is clockwise direction; the wedge member is at the second stop position by a pre-tightening force and the predetermined direction is counter-clockwise direction.

Further, the wrench further comprises a reversing apparatus for moving the wedge member between the first stop position and the second stop position.

Further, the wrench further comprises a holding frame and the wedge member is mounted on the holding frame.

Further, the holding frame is cage-like.

Further, the reversing apparatus comprises a knob and a reversing shaft, and the knob is mounted on one end of the reversing shaft. The knob is fixedly connected to the holding frame and the reversing shaft and the torque output member are coaxial.

Further, the reversing apparatus also comprises two beads in the opposite recesses on the side facing the torque output member of the knob. By adopting such a configuration, the force applied on the beads has a larger moment, thus a greater pre-tightening force can be provided, which can effectively reduce the interval, making the operation smoother.

Further, the wrench also comprises a sheath-off apparatus.

Further, the sheath-off apparatus comprises the reversing shaft and a spring, the spring being arranged between the reversing shaft and the knob. With this structure, when the reversing shaft moves away from the torque output member, due to the elastic force toward the torque output member, the knob will not move away from the torque output member, thus the beads arranged at the recesses of the knob will not move away from the torque output member, and thus the beads will not come off from the recesses, resulting in unexpected reversion. Therefore the wrench according to the present embodiment can reliably guarantee a predetermined direction in use.

Further, the reversing apparatus comprises a toggle, and knob is fixedly connected to the holding frame.

The wrench according to the present embodiment has the following beneficial effects: when the handle idles relative to the torque output member, only the wedge members will leave the stop position and no sound will be made. Such a wrench is a quiet wrench. Adopting such a configuration not only can reduce wearing of the wrench and extend the service life of the wrench. And at the meantime, because the wrench is quiet, the user's experience will be improved. Providing pre-tightening force can effectively reduce the interval and make the operation smoother.

A further description will be made as to the conception, detailed structure, and expected technical effects of the present invention with reference to the accompanying drawings to make the objects, features, and advantages of the present invention fully understood.

DETAILED DESCRIPTION OF THE PREFERRED EMBODIMENTS

Figure 1:
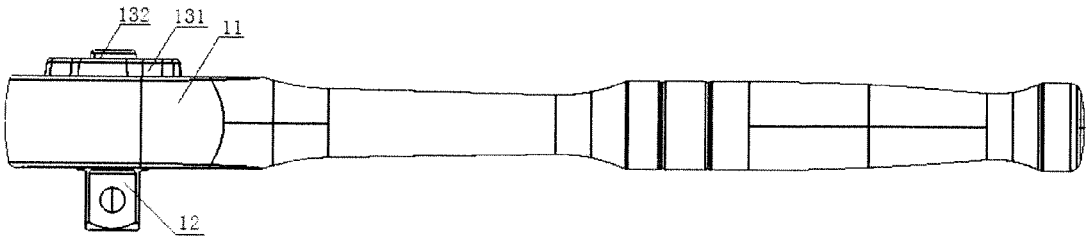
FIG. 1 is a front view of the wrench comprising a one-way clutch according to an embodiment of the present invention.
Figure 2:
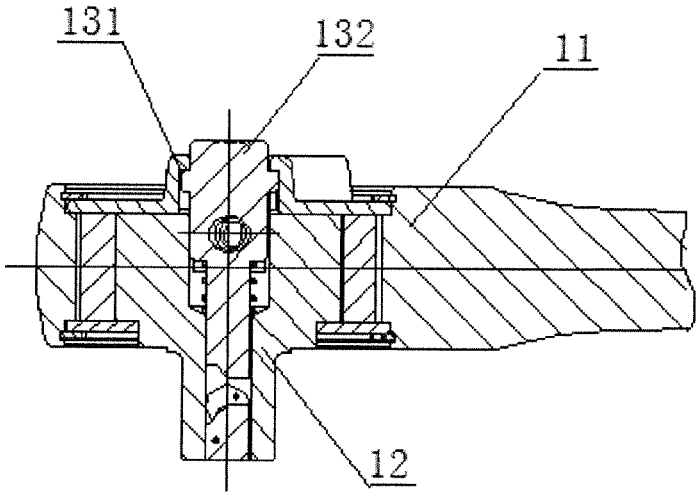
FIG. 2 is a front partial sectional view of the wrench shown in FIG. 1.
Figure 3:
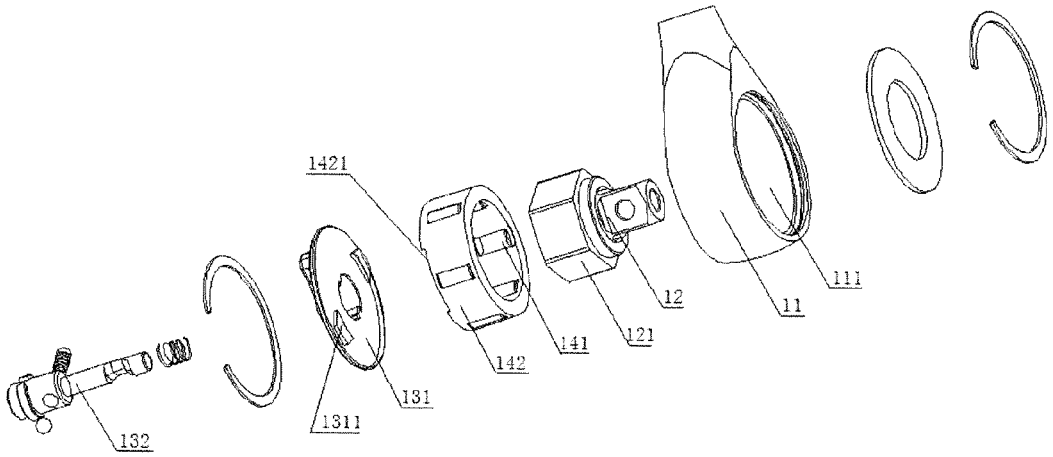
FIG. 3 is an exploded view of the wrench shown in FIG. 2.

FIG. 1 is a front view of the wrench comprising a one-way clutch according to an embodiment of the present invention. FIG. 2 is a front partial sectional view of the wrench shown in FIG. 1. FIG. 3 is an exploded view of the wrench shown in FIG. 2. As shown in FIGS. 1-3, the wrench comprising a one-way clutch according to the present embodiment comprises a handle 11 and a torque output member 12.

As shown in FIG. 3, the cylindrical inner surface of the handle 11 is the first surface 111; the cylindrical outer surface of the torque output member 12 is the second surface 121; the first surface 111 and the second surface 121 are arranged coaxially.

Figure 4:
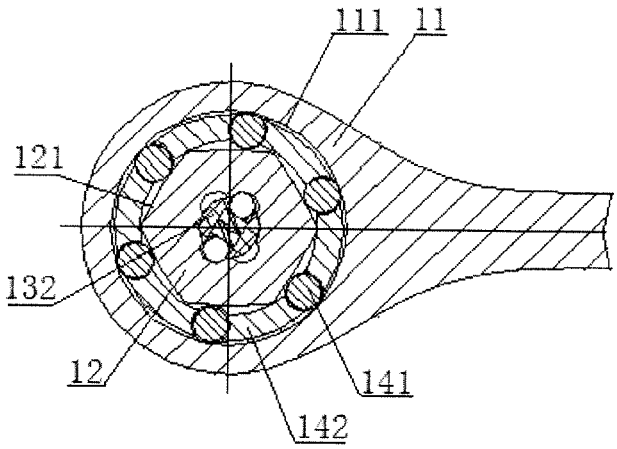
FIG. 4 is a top partial sectional view of the one-way clutch of the wrench shown in FIG. 2, wherein the wedge members are in the first stop position.
Figure 5:
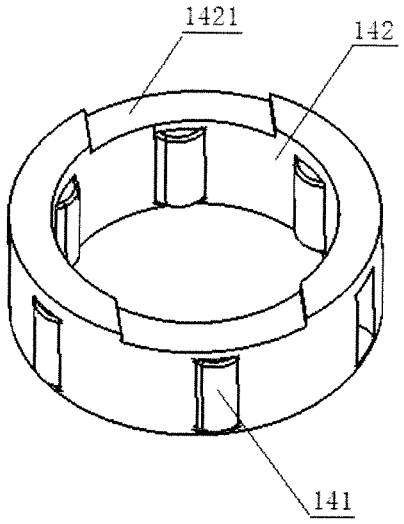
FIG. 5 is a perspective view of the wedge members and the holding frame of the one-way clutch of the wrench shown in FIG. 2.

In the present embodiment, six wedge members 141 are arranged between the first surface 111 and the second surface 121. As shown in FIG. 4, the wedge member 141 is cylindrical and the wedge members 141 are installed in a cage-like holding frame 142, which can ensure that the wedge members 141 are axially parallel to the first surface 111 to facilitate the rotation of the wedge members 141 between the first surface 111 and the second surface 121.

The holding frame 142 is closed. In the manufacturing process of the wrench, the wedge members 141 are wedged into the holding frame 142 first, and then the formed holding frame 142 with wedge members 141 is integrally assembled; thus the assembly of the wrench can be simplified.

The wedge member 141 may also be spherical structure.

The one-way clutch of the present embodiment comprises a first surface 111;

a second surface 121;

the first surface 111 and the second surface 121 being cylindrically curved surfaces, and the second surface 121 being located inside the first surface 111;

a plurality of wedge members 141, arranged between the first surface 111 and the second surface 121; and a distance between the first surface 111 and the second surface 121, which varies along the radial direction of the first surface 111, so that the wedge members 141 can prevent the rotation of the first surface 111 relative to the second surface 121 in a predetermined direction.

The number of wedge member 141 may also be one.

In the present embodiment, the first surface 111 is a cylindrically curved surface, and the cross-sectional profile of the second surface 121 is hexagon. The cross-sectional profile of the second surface 121 includes fold lines, and the fold lines are evenly distributed along the radial direction of the second surface 121.

The first surface 111 and the second surface 121 of the present invention are not limited to the above-described curved surfaces, as long as there is a varied distance between the first surface and the second surface, so that the wedge member can prevent the rotation of the first surface relative to the second surface in a predetermined direction.

There may be the following situations:

(1) the first surface is cylindrically curved surface, i.e., not having radius varying along the radial direction of the first surface; and the second surface has radius varying along the radial direction of the first surface, e.g., the cross-sectional profile of the second surface comprising fold line(s) or arc line(s);

(2) the first surface has radius varying along the radial direction of the first surface, e.g., the cross-sectional profile of the second surface comprising fold line(s) or arc line(s); and the second surface is cylindrically curved surface, i.e., not having radius varying along the radial direction of the second surface;

(3) the first surface has radius varying along the radial direction of the first surface, and the second surface has radius varying along the radial direction of the first surface.

All of the above situations can make a varied distance between the first surface and the second surface, so that the wedge member 141 can prevent the rotation of the first surface 111 relative to the second surface 121 in a predetermined direction.

When there are more than one fold lines or arc lines, the lines may be evenly or unevenly distributed along the radial direction.

The position where the distance between the first surface 111 and the second surface 121 varies clockwise from longer than the diameter of the wedge member 141 to shorter than the diameter of the wedge member 141 forms a first stop position. The wedge members 141 are at the first stop position by a pre-tightening force applied to the second surface 121, as shown in FIG. 4.

When the first surface 111 is rotated clockwise relative to the second surface 121, the first surface 111 contacting with the wedge members 141 will drive the wedge members 141 to rotate clockwise. Because the wedge members 141 are in the wedge-shaped position formed by the first surface 111 and the second surface 121, i.e., the first stop position, the wedge members 141 can not be rotated clockwise, which enables the wedge members 141 to prevent the clockwise rotation of the first surface 111 relative to the second surface 121, in other words, the first surface 111 drives the second surface 121 to rotate clockwise.

When the first surface 111 is rotated counter-clockwise relative to the second surface 121, the first surface 111 contacting with the wedge members 141 will drive the wedge members 141 to rotate counter-clockwise, which makes the wedge members 141 leave the wedge-shaped position formed by the first surface 111 and the second surface 121, i.e., the first stop position, and thus the wedge members 141 can not prevent the counter-clockwise rotation of the first surface 111 relative to the second surface 121, in other words, the first surface 111 does not drive the second surface 121 to rotate counter-clockwise.

The predetermined direction is clockwise direction.

Figure 6:
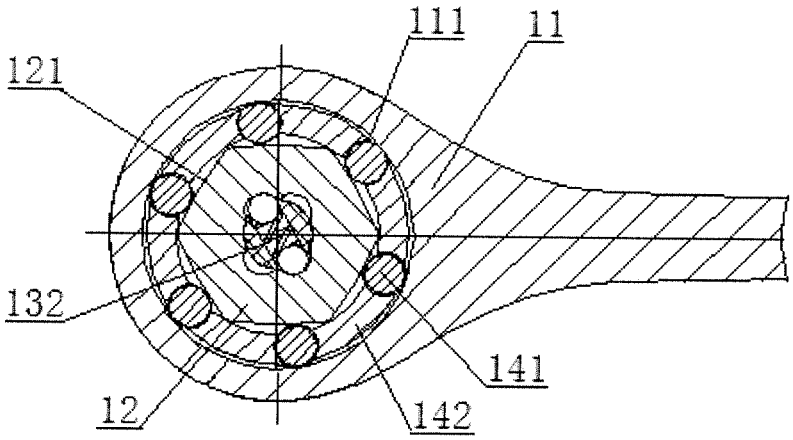
FIG. 6 is a top partial sectional view of the one-way clutch of the wrench shown in FIG. 2, wherein the wedge members are in the second stop position.

The position where the distance between the first surface 111 and the second surface 121 varies clockwise from shorter than the diameter of the wedge member 141 to longer than the diameter of the wedge member 141 forms a second stop position. The wedge members 141 are at the second stop position by a pre-tightening force applied to the second surface 121, as shown in FIG. 6.

When the first surface 111 is rotated clockwise relative to the second surface 121, the first surface 111 contacting with the wedge members 141 will drive the wedge members 141 to rotate clockwise, which makes the wedge members 141 leave the wedge-shaped position formed by the first surface 111 and the second surface 121, i.e., the second stop position, and thus the wedge members 141 can not prevent the clockwise rotation of the first surface 111 relative to the second surface 121, in other words, the first surface 111 does not drive the second surface 121 to rotate clockwise.

When the first surface 111 is rotated counter-clockwise relative to the second surface 121, the first surface 111 contacting with the wedge members 141 will drive the wedge members 141 to rotate counter-clockwise. Because the wedge members 141 are in the wedge-shaped position formed by the first surface 111 and the second surface 121, i.e., the second stop position, the wedge members 141 can not be rotated counter-clockwise, which enables the wedge members 141 to prevent the counter-clockwise rotation of the first surface 111 relative to the second surface 121, in other words, the first surface 111 drives the second surface 121 to rotate clockwise.

The predetermined direction is counter-clockwise direction.

The one-way clutch according to the present embodiment adopts the wedge members 141 to prevent the rotation of the first surface 111 relative to the second surface 121 in a predetermined direction. When the first surface 111 idles relative to the second surface 121, only the wedge members 141 will leave the stop position and no sound will be made. Adopting such a configuration can not only reduce wearing but also extend the service life of the one-way clutch.

The wrench according to the present embodiment adopts the wedge members 141 to prevent the rotation of the first surface 111 relative to the second surface 121 in a predetermined direction, that means the handle 11 drives the torque output member 12 to rotate; while in the opposite direction to the predetermined direction, the wedge members 141 leave the stop position, and the first surface 111 rotates in the direction opposite the predetermined direction without driving the second surface 121 to rotate, that means the handle 11 does not drive the torque output member 12 to rotate and the handle 11 idles relative to the torque output member 12.

In the wrench according to the present embodiment, when the handle 11 idles relative to the torque output member 12, only the wedge members 141 will leave the stop position and no sound will be made. Such a wrench is a quiet wrench. Adopting such a configuration can not only reduce wearing of the wrench but also extend the service life of the wrench. And because the wrench is quiet, the user's experience will be improved.

The wrench according to the present embodiment further comprises a reversing apparatus for moving the wedge members 141 between the first stop position and the second stop position.

The reversing apparatus comprises a knob 131 and a reversing shaft 132, and the knob 131 is mounted on one end of the reversing shaft 132. As shown in FIG. 3, the knob 131 is arranged with a projection on the side facing the holding frame 142, and the holding frame 142 is arranged with a recess mating with the projection on the side facing the knob 131, and thus the knob 131 can drive the holding frame 142 to rotate.

The torque output member 12 is arranged sheathing the reversing shaft 132. One end of the reversing shaft 132 is arranged with a through-hole, and a spring is arranged in the through-hole, and each opening of the through-hole are arranged with a bead. The inner side of the torque output member 12 is arranged with two sets of opposite dents.

Turn the knob 131, so that the beads arranged at the openings of the through-hole are in the set of opposite dents shown in FIG. 4, and through the pre-tightening force applied by the holding frame 142 to the wedge members 141, the wedge members 141 are in the first stop position. And the predetermined direction is clockwise direction, which means if the handle 11 is rotated clockwise, the handle 11 drives the torque output member 12 to rotate; if the handle 11 is rotated counter-clockwise, the handle 11 dose not drive the torque output member 12 to rotate but idles relative to the torque output member 12.

Turn the knob 131, so that the beads arranged at the openings of the through-hole are in the set of opposite dents shown in FIG. 6, and through the pre-tightening force applied by the holding frame 142 to the wedge members 141, the wedge members 141 are in the second stop position. And the predetermined direction is counter-clockwise direction, which means if the handle 11 is rotated counter-clockwise, the handle 11 drives the torque output member 12 to rotate; if the handle 11 is rotated clockwise, the handle 11 dose not drive the torque output member 12 to rotate but idles relative to the torque output member 12.

Figure 7:
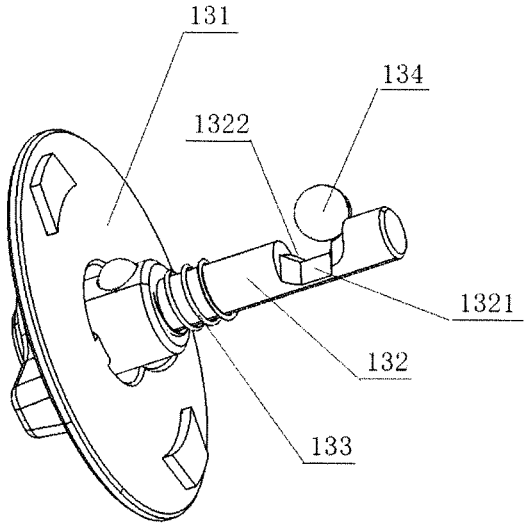
FIG. 7 is a perspective view of sheath-off apparatus of the wrench shown in FIG. 2.

The wrench according to the present embodiment further comprises a sheath-off apparatus. As shown in FIG. 7, the sheath-off apparatus comprises beads, knob 131, reversing shaft 132 arranged on the torque output member 12 and spring 133 sheathing the shaft 132, a first groove and a second groove are arranged on the reversing shaft in the position corresponding to the bead.

When the reversing shaft 132 is pressed, the bead can enter the first groove 1321 or the second groove 1322 to complete the sheath-off; when the reversing shaft 132 is released, the elastic force arranged by the spring 133 return the reversing shaft 132 to its original position, making the bead pop out again.

Figure 8:
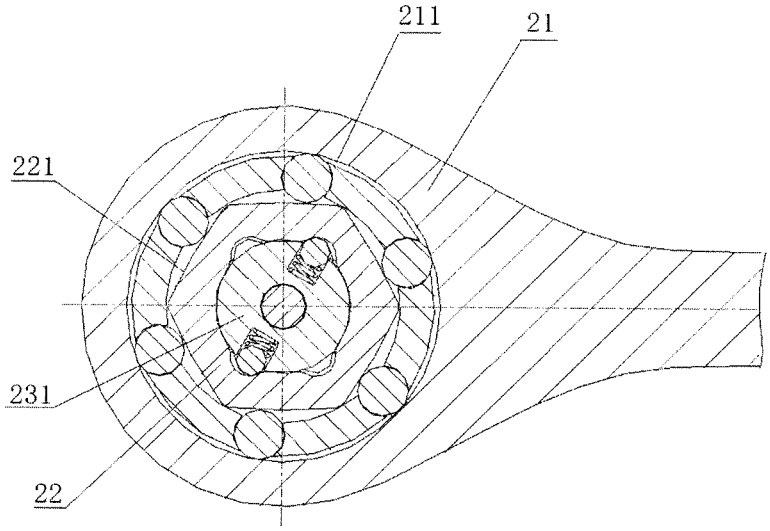
FIG. 8 is a top partial sectional view of the one-way clutch of the wrench according to another embodiment of the present invention, wherein the wedge members are in the first stop position.
Figure 9:
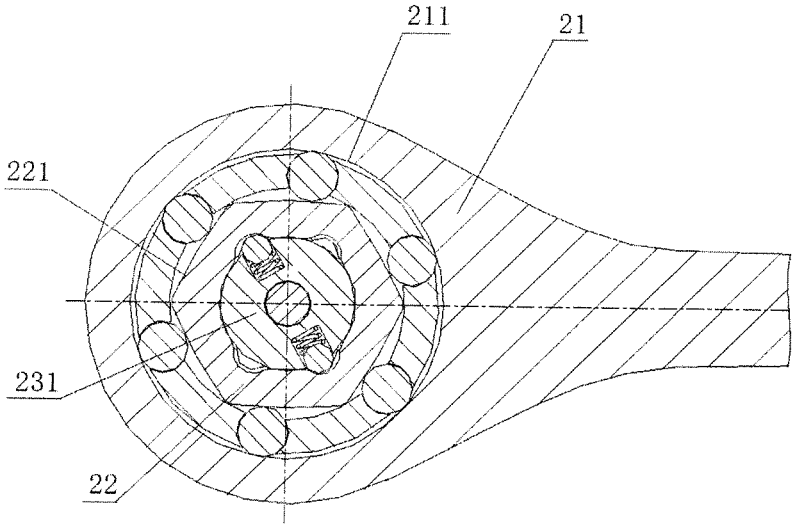
FIG. 9 is a top partial sectional view of the one-way clutch of the wrench shown in FIG. 8, wherein the wedge members are in the second stop position.

FIG. 8 is a top partial sectional view of the one-way clutch of the wrench according to another embodiment of the present invention, wherein the wedge members are in the first stop position; FIG. 9 is a top partial sectional view of the one-way clutch of the wrench shown in FIG. 8, wherein the wedge members are in the second stop position.

As shown in FIG. 8 and FIG. 9, the wrench according to the present embodiment comprises a handle 21 and a torque output member 22, the inner surface of the handle 21 being the first surface 211, the outer surface of the torque output member 22 being the second surface 221, six wedge members being mounted in the cage-like holding frame and arranged between the first surface 211 and second surface 221.

The difference between the present embodiment and the embodiment shown in FIGS. 1-7 is that: the spring and the two beads arranged at the through-hole are substituted by two opposite side recesses and two beads arranged respectively on the side of the knob 231 facing the torque output member. By adopting such a configuration, the force applied on the beads has a larger moment, thus a greater pre-tightening force can be arranged, which can effectively reduce the interval, making the operation smoother.

As to the wrench according to the embodiment shown in FIGS. 1-7, when the reversing shaft 132 is pressed, the spring 133 will be compressed to operate the sheath-off; when the reversing shaft 132 is released, the reversing shaft 132 will move away from the torque output member 12 back to the position before sheath-off due to the elastic force of the spring 133. The movement of the reversing shaft 132 away from the torque output member 12 drives the beads at the through-hole of the reversing shaft 132 to move away from the torque output member 12, which may cause the beads to come off from the dents on the inner side of the torque output member 12 in the direction parallel to the axis of the reversing shaft 132, resulting in unexpected reversion.

Figure 10:
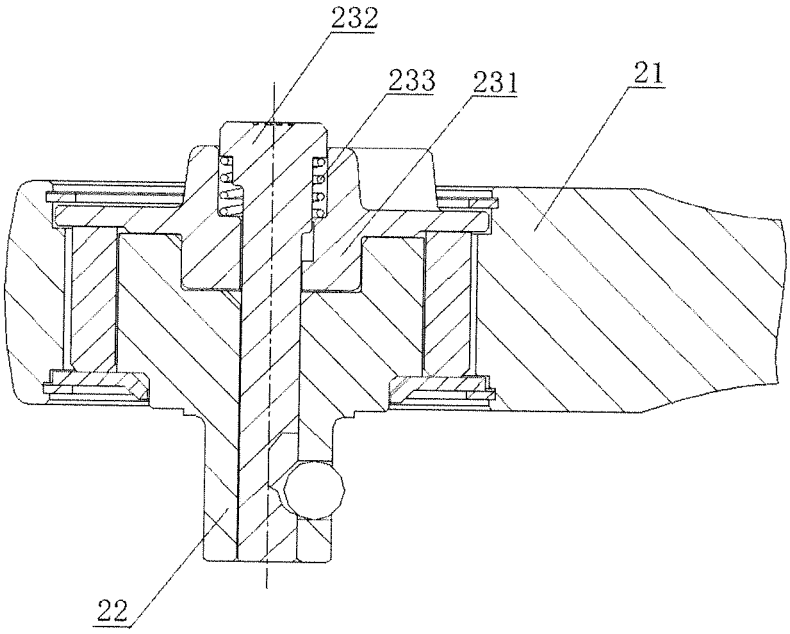
FIG. 10 is a side partial sectional view of the wrench shown in FIG. 8.
Figure 11:
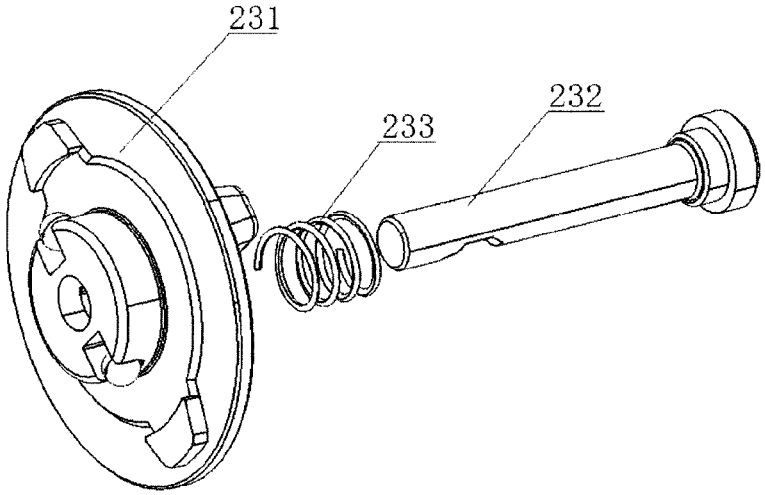
FIG. 11 is a diagram of the connection relationship between the reversing shaft and the knob of the wrench shown in FIG. 8.
Figure 12:
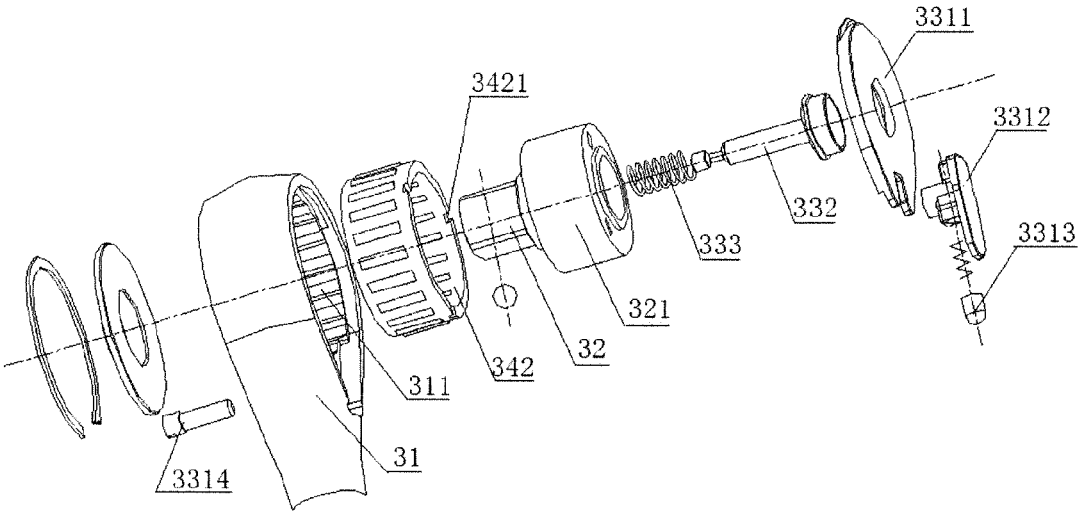
FIG. 12 is an exploded view of the wrench according to yet another embodiment of the present invention.

As to the wrench according to the embodiment shown in FIGS. 10, 11, two beads are arranged in two opposite recesses of the knob 231 and a spring 233 is arranged between the knob 231 and the reversing shaft 232. When the reversing shaft 232 is pressed, the spring 233 will be compressed to operate the sheath-off; when the reversing shaft 232 is released, the reversing shaft 232 will move away from the torque output member 22 back to the position before sheath-off due to the elastic force of the spring 233. When the reversing shaft 232 moves away from the torque output member 22, due to the elastic force toward the torque output member 22, the knob 231 will not move away from the torque output member 22, thus the beads arranged at the recesses of the knob 231 will not move away from the torque output member 22, and thus the beads will not come off from the recesses, resulting in unexpected reversion. Therefore the wrench according to the present embodiment can reliably guarantee a predetermined direction in use.

As shown in FIGS. 12-16, the wrench according to yet another embodiment comprises a handle 31 and a torque output member 32, the inner surface of the handle 31 being the first surface 311, the outer surface of the torque output member 32 being the second surface 321, wedge members being mounted in the cage-like holding frame and arranged between the first surface 311 and second surface 321.

Figure 14:
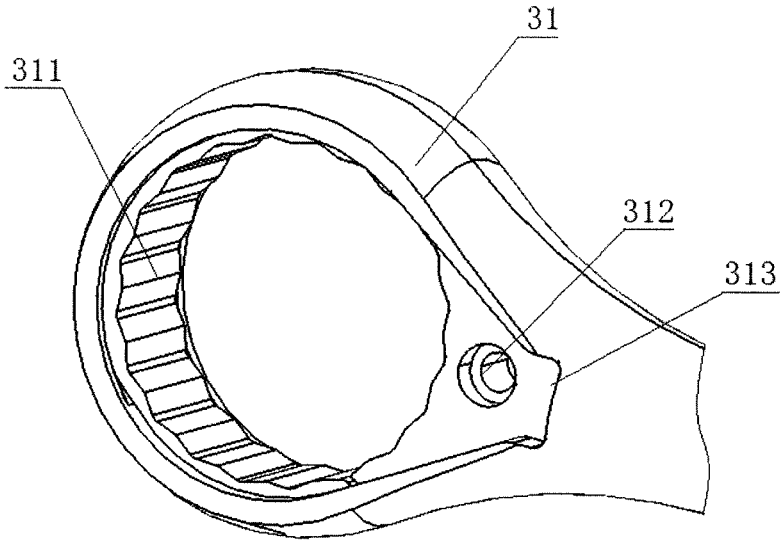
FIG. 14 is a partial perspective view of the handle of the wrench shown in FIG. 12.

As shown in FIG. 14, the profile of the cross section of the first surface 311 includes a plurality of fold lines.

The profile of the cross section of the first surface 311 may also include a plurality of arc lines.

Figure 15:
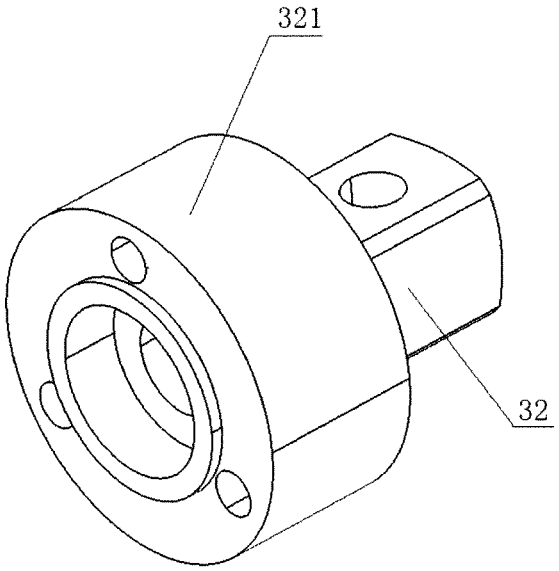
FIG. 15 is a perspective view of the torque output member of the wrench shown in FIG. 12.

As shown in FIG. 15, the second surface 321 is a cylindrical surface.

A varied distance is formed between the first surface 311 and the second surface 321, so that the wedge members 141 between the first surface 311 and the second surface 321 can prevent the rotation of the first surface 311 relative to the second surface 321 in a predetermined direction.

It may also be adopted that the first surface 311 is a cylindrically curved surface, and the cross-sectional profile of the second surface 321 includes a plurality of fold lines.

Figure 16:
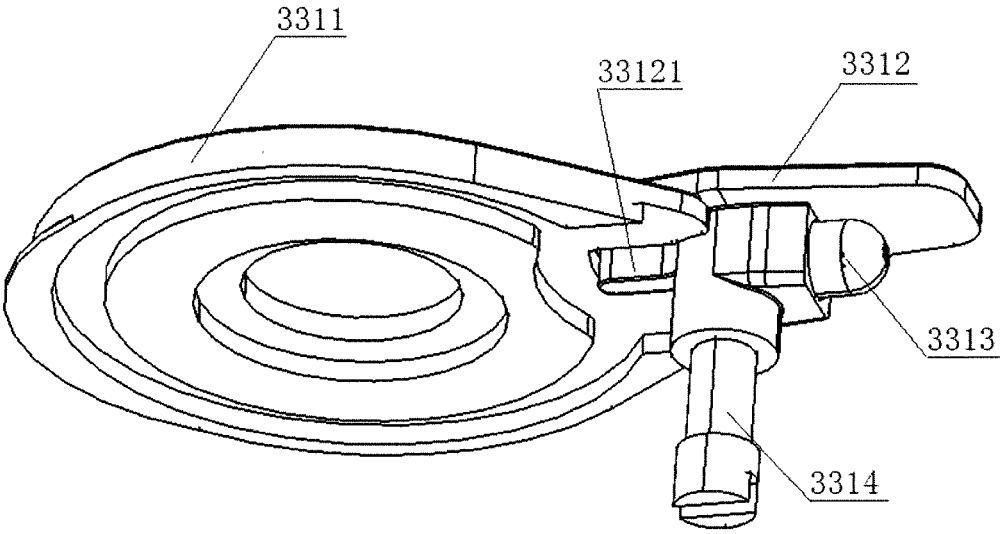
FIG. 16 is a diagram of the connection relationship of the toggle of the wrench shown in FIG. 12.

As shown in FIG. 16, the wrench according to the present embodiment adopts a toggle 3312 to achieve the reversion, and the toggle 3312 is embedded in the recess of the cover 3311. The protrusion 33121 of the toggle 3312 is embedded in the groove 3421 of the holding frame 342, so that turning the toggle can rotate the holding frame 342, and thus the wedge member can move between the first stop position and the second stop position.

The toggle 3312 is coaxially connected with the screw 3314. When the toggle 3312 is turned, the toggle 3312 will rotate around the screw 3314. The toggle 3312 and the screw 3314 are mounted in the through-hole 312 of the handle 31, as shown in FIG. 13.

Figure 13:
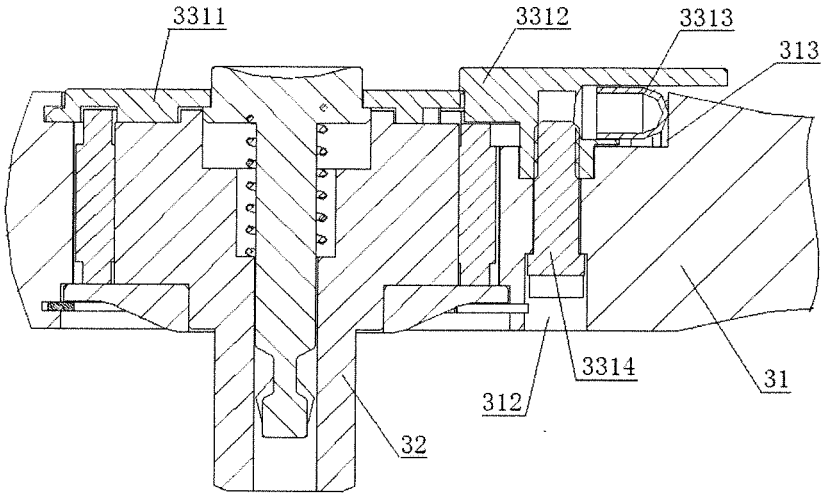
FIG. 13 is a partial sectional view of the handle of the wrench shown in FIG. 12.

As shown in FIG. 13, a hollow ball plunger 3313 is arranged in the hole opposite to the protrusion 33121 of the toggle 3312. A spring is arranged in the hollow of the ball plunger 3313, and the ball plunger 3313 push the recess 313 of the handle 31. Turning the toggle 3312 will make the ball plunger provide pre-tightening force in different direction to the holding frame 342, which can effectively reduce the interval, making the operation smoother.

The wrench according to the present embodiment has the following beneficial effects: when the handle idles relative to the torque output member, only the wedge members 141 will leave the stop position and no sound will be made. Such a wrench is a quiet wrench. Adopting such a configuration not only can reduce wearing of the wrench and extend the service life of the wrench. And at the meantime, because the wrench is quiet, the user's experience will be improved. Providing pre-tightening force can effectively reduce the interval and make the operation smoother.

The invention has been exemplified above with reference to specific embodiments. However, it should be understood that a multitude of modifications and varieties can be made by a common person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A one-way clutch comprising:

a first surface;

a second surface;

said first surface and said second surface being cylindrically curved surfaces, said second surface being located inside said first surface;

one or more wedge member(s), arranged between said first surface and said second surface; and a distance between said first surface and said second surface varying along the radial direction of the first surface, so that said wedge member(s) can prevent the rotation of said first surface relative to said second surface in a predetermined direction;

wherein said wedge member is cylindrical structure or spherical structure;

wherein said wedge member is at said first stop position by a pre-tightening force applied to said second surface and said predetermined direction is clockwise direction; said wedge member is at said second stop position by a pre-tightening force and said predetermined direction is counter-clockwise direction;

said one-way clutch further comprises a reversing apparatus for moving said wedge member between a first stop position and a second stop position, and a holding frame, said wedge member is mounted on the holding frame; wherein said reversing apparatus comprises a knob and a reversing shaft, said knob being mounted on one end of the reversing shaft, said knob being fixedly connected to said holding frame, said reversing shaft and said torque output member being coaxial;

said reversing apparatus also comprises two beads in the opposite recesses on the side facing the torque output member of the knob.

2. A one-way clutch according to claim 1, wherein said first surface and said second surface are arranged coaxially.

3. A one-way clutch according to claim 2, wherein at least one of said first surface and said second surface has radius varying along the radial direction of said first surface.

4. A one-way clutch according to claim 3, wherein said first surface is cylindrically curved surface and said second surface has radius varying along the radial direction of said second surface.

5. A one-way clutch according to claim 4, wherein the cross-sectional profile of said second surface includes fold line or arc line.

6. A one-way clutch according to claim 5, wherein said fold line or arc line is one or more.

7. A one-way clutch according to claim 6, wherein when there are more than one fold lines or arc lines, said lines are evenly distributed along the radial direction of said second surface.

8. A one-way clutch according to claim 7, wherein the cross-sectional profile of said second surface is hexagonal.

9. A one-way clutch according to claim 2, wherein said second surface is cylindrically curved surface and said first surface has radius varying along the radial direction of said first surface.

10. A one-way clutch according to claim 9, wherein the cross-sectional profile of said first surface includes fold line or arc line.

11. A one-way clutch according to claim 10, wherein said fold line or arc line is one or more.

12. A one-way clutch according to claim 11, wherein when there are more than one fold lines or arc lines, said lines are evenly distributed along the radial direction of said first surface.

13. A one-way clutch according to claim 2, wherein both said first surface and said second surface have radius varying along the radial direction of said first surface.

14. A one-way clutch according to claim 1, wherein when said wedge member is cylindrical structure, the axis of said wedge member is parallel to the axis of said first surface.

15. A one-way clutch according to claim 1, wherein the position where the distance between said first surface and said second surface varies clockwise from longer than the diameter of said wedge member to shorter than the diameter of said wedge member forms said first stop position; the position where the distance between said first surface and said second surface varies clockwise from shorter than the diameter of said wedge member to longer than the diameter of said wedge member forms said second stop position.

16. A one-way clutch according to claim 1, wherein said wedge member is at said first stop position by a pre-tightening force applied to said second surface and said predetermined direction is clockwise direction; said wedge member is at said second stop position by a pre-tightening force and said predetermined direction is counter-clockwise direction.

17. A one-way clutch according to claim 16, wherein said holding frame is cage-like structure.

18. A wrench, comprising:

a handle for torque input, a first end of said handle having a cylindrical inner surface as a first surface;

a torque output member, arranged in said first surface of said handle, said torque output member having a cylindrical outer surface as a second surface;

one or more wedge member(s), arranged between said first surface and said second surface; and a distance between said first surface and said second surface varying along the radial direction of the first surface, so that said wedge member(s) can prevent the rotation of said first surface relative to said second surface in a predetermined directions;

wherein said wedge member is cylindrical structure or spherical structure;

wherein said wedge member is at said first stop position by a pre-tightening force applied to said second surface and said predetermined direction is clockwise direction; said wedge member is at said second stop position by a pre-tightening force and said predetermined direction is counter-clockwise direction;

said one-way clutch further comprises a reversing apparatus for moving said wedge member between a first stop position and a second stop position, and a holding frame, said wedge member is mounted on the holding frame; wherein said reversing apparatus comprises a knob and a reversing shaft, said knob being mounted on one end of the reversing shaft, said knob being fixedly connected to said holding frame, said reversing shaft and said torque output member being coaxial;

said reversing apparatus also comprises two beads in the opposite recesses on the side facing the torque output member of the knob.

19. A wrench according to claim 18, wherein said first surface and said second surface are arranged coaxially.

20. A wrench according to claim 19, wherein at least one of said first surface and said second surface has radius varying along the radial direction of the first surface.

21. A wrench according to claim 20, wherein said first surface is cylindrically curved surface and said second surface has radius varying along the radial direction of said second surface.

22. A wrench according to claim 21, wherein the cross-sectional profile of said second surface includes fold line or arc line.

23. A wrench according to claim 22, wherein said fold line or arc line is one or more.

24. A wrench according to claim 23, wherein when there are more than one fold lines or arc lines, said lines are evenly distributed along the radial direction of said second surface.

25. A wrench according to claim 24, wherein the cross-sectional profile of said second surface is hexagonal.

26. A wrench according to claim 19, wherein said second surface is cylindrically curved surface and said first surface has radius varying along the radial direction of said first surface.

27. A wrench according to claim 26, wherein the cross-sectional profile of said first surface includes fold line or arc line.

28. A wrench according to claim 27, wherein said fold line or arc line is one or more.

29. A wrench according to claim 28, wherein when there are more than one fold lines or arc lines, said lines are evenly distributed along the radial direction of said first surface.

30. A wrench according to claim 19, wherein both said first surface and said second surface have radii varying along the radial direction of said first surface.

31. A wrench according to claim 18, wherein when said wedge member is cylindrical structure, the axis of said wedge member is parallel to the axis of said first surface.

32. A wrench according to claim 18, wherein the position where the distance between said first surface and said second surface varies clockwise from longer than the diameter of said wedge member to shorter than the diameter of said wedge member forms said first stop position; the position where the distance between said first surface and said second surface varies clockwise from shorter than the diameter of said wedge member to longer than the diameter of said wedge member forms said second stop position.

33. A wrench according to claim 18, wherein said holding frame is cage-like structure.

34. A wrench according to claim 18, wherein said wrench further comprises a sheath-off apparatus.

35. A wrench according to claim 34, wherein said sheath-off apparatus comprises said reversing shaft and a spring, said spring being arranged between said reversing shaft and said knob.

* * * * *